US010544906B1

(12) United States Patent
Openiano

(10) Patent No.: US 10,544,906 B1
(45) Date of Patent: Jan. 28, 2020

(54) OMNIDIRECTIONAL LED LIGHT TUBE

(71) Applicant: Renato Martinez Openiano, Chula Vista, CA (US)

(72) Inventor: Renato Martinez Openiano, Chula Vista, CA (US)

( * ) Notice: Subject to any disclaimer, the term of this patent is extended or adjusted under 35 U.S.C. 154(b) by 0 days.

(21) Appl. No.: 16/040,880

(22) Filed: Jul. 20, 2018

Related U.S. Application Data

(60) Provisional application No. 62/604,823, filed on Jul. 20, 2017.

(51) Int. Cl.

| | |
|---|---|
| ***F21K 9/232*** | (2016.01) |
| ***F21K 9/238*** | (2016.01) |
| ***F21V 19/00*** | (2006.01) |
| *F21Y 103/10* | (2016.01) |
| *F21Y 107/30* | (2016.01) |
| *F21Y 115/10* | (2016.01) |

(52) U.S. Cl.
CPC ..... *F21K 9/232* (2016.08); *F21K 9/238* (2016.08); *F21V 19/003* (2013.01); *F21Y 2103/10* (2016.08); *F21Y 2107/30* (2016.08); *F21Y 2115/10* (2016.08)

(58) Field of Classification Search
CPC . F21K 9/27; F21K 9/232; F21K 9/237; F21K 9/238; F21K 9/278; F21V 19/003; F21Y 2107/30
See application file for complete search history.

(56) References Cited

U.S. PATENT DOCUMENTS

| | | | | |
|---|---|---|---|---|
| 7,581,856 | B2 * | 9/2009 | Kang | F21V 29/004 362/373 |
| 2005/0168985 | A1 * | 8/2005 | Chen | F21V 19/001 362/241 |
| 2007/0159828 | A1 * | 7/2007 | Wang | F21V 3/00 362/294 |
| 2018/0010776 | A1 * | 1/2018 | Shim | F21V 29/77 |

* cited by examiner

*Primary Examiner* — Julie A Bannan
(74) *Attorney, Agent, or Firm* — Michael D. Eisenberg

(57) ABSTRACT

An elongated LED lighting apparatus comprises a central rod, a plurality of installation wheels, a plurality of LEDs, and a plurality of circuit boards. The installation wheels are configured for being traversed by the central rod and each comprises: a loop configured to be traversed by the central rod; a plurality of circuit board holders extending radially outward from an outer surface of the loop; a plurality of spikes extending radially outward from the loop. The elongated circuit boards are configured to be electrically connected to a power source, each circuit board being configured for transferring power to respective ones of the LEDs and for holding the respective LEDs along a longitudinal length of the circuit board, each circuit board being configured for engaging with and being held by a plurality of circuit board holders aligned with each other, such that the respective LEDs face radially outward.

20 Claims, 12 Drawing Sheets

OMNIDIRECTIONAL LED LIGHT TUBE

CROSS-REFERENCES TO RELATED APPLICATIONS

The present application claims priority from U.S. Provisional Application Ser. No. 62/604,823 filed on Jul. 20, 2017, which is hereby incorporated herein by reference in its entirety.

TECHNICAL FIELD

The present application, in some embodiments thereof, relates to the field of electrical lighting. More specifically, it relates to an apparatus for providing omnidirectional LED (Light Emitting Diode) illumination.

BACKGROUND

A LED lamp or LED light bulb is an electric light for use in light fixtures that produces light using light-emitting diode (LED). LED lamps have a lifespan and electrical efficiency which are several times greater than incandescent lamps, and are significantly more efficient than most fluorescent lamps, with some chips able to emit more than 300 lumens per watt. The LED lamp market is projected to grow by more than twelve-fold over the next decade, from $2 billion in the beginning of 2014 to $25 billion in 2023.

Contemporary bulbs typically used a single large LED or matrix of LEDs. Therefore, these bulbs typically produced only a 180-degree range of light. By the mid-2010s, LED filaments were being introduced into the market by several manufacturers. These designs used several LED filament light producers arranged in the same or similar pattern to that found in the wires of standard incandescent bulb.

The LED filament consists of multiple series-connected LEDs on a transparent substrate, referred to as Chip-On-Glass (COG). These transparent substrates are made of glass or sapphire materials. This transparency allows the emitted light to disperse evenly and uniformly without any interference. An even coating of yellow phosphor in a silicone resin binder material converts the blue light generated by the LEDs into white light.

Although LED filament bulbs produce omnidirectional light just as much as incandescent lights, LED filament bulbs generally reach lengths up to about eight inches. Moreover, LED filament bulbs have a relatively short life span of 15.000 to 28,000 hours.

BRIEF SUMMARY OF THE INVENTION

There is therefore a need for an omni-directional LED-based lamp that can be longer than LED filaments and may even reach a length of 48 inches and be used as an eco-friendly substitute for traditional 48-inch fluorescent light bulbs. There is also a need for an omni-directional LED-based light bulb having longer life span than the LED filaments.

The present invention relates to a novel apparatus for use in omni-directional LED bulbs. The apparatus of the present invention provides support for two or more elongated circuit boards to be located inside a bulb. Each circuit board is configured for connecting to a plurality of LEDs disposed along a line substantially parallel to the circuit board's long side. Furthermore, the apparatus of the present invention includes spikes configured to brace against the tube/enclosure of the bulb to hold the LEDs at a desired distance from the inner wall of the bulb and to provide structural strength to the apparatus. In this manner, the apparatus can be strong enough to extend to lengths of 48 inches, and even more.

Therefore, an aspect of some embodiments of the present invention relates to an elongated LED (light emitting diode) lighting apparatus, comprising a central rod, a plurality of installation wheels, a plurality of LEDs, and a plurality of circuit boards. The installation wheels are configured for being traversed by the central rod and each comprises: a loop configured to be traversed by the central rod, the loop having an inner surface configured to engage with the central rod; a plurality of circuit board holders extending radially outward from an outer surface of the loop; a plurality of spikes extending radially outward from the loop. The elongated circuit boards are configured for be electrically connected to a power source, each circuit board being configured for transferring power to respective ones of the LEDs and for holding the respective LEDs along a longitudinal length of the circuit board, each circuit board being configured for engaging with and being held by a plurality of circuit board holders aligned with each other, such that the respective LEDs face radially outward.

In a variant, the central rod has a radial profile, and the inner surface of each loop has an inner radial profile keyed to match the radial profile of the central rod, such that the installation wheels can be traversed by the central rod only when having a desired orientation. The circuit board holders of the wheels are oriented in the same manner with respect to the inner radial profiles, such that when the wheels are installed on the central rod, the circuit board holders of different wheels are aligned with each other.

In another variant, at least some of the spikes extend from at least some of the circuit board holders. The circuit boards have holes configured for being traversed by the spikes.

In yet another variant, the spikes are located on an outer surface of the loop and are radially longer than the circuit board holders.

In a further variant, at least some of the circuit boards have notches along elongated sides thereof. At least some of the circuit board holders comprise grips configured for engaging the circuit boards at the notches.

In a variant, the apparatus further comprises a hollow tube configured for holding the central rod, the installation wheels, and circuit boards, such that the spikes of the installation wheels brace against an inner wall of the tube, so as to maintain a desired distance between the circuit boards and the inner wall of the tube along the length of the tube and to impart structural strength from the hollow tube to the central rod, the tube being configured for allowing at least some of the light from the LEDs to pass through the tube.

In another variant, the apparatus comprises an end spike located at an end of the central rod and extending along a longitudinal axis of the central rod.

Optionally, the apparatus comprises a hollow tube configured for holding the central rod, the installation wheels, and circuit boards, such that the spikes of the installation wheels and the end spike brace against an inner wall of the tube, so as to maintain a desired distance between the circuit boards and the inner wall of the tube along the length of the tube and to impart structural strength from the hollow tube to the central rod, the tube being configured for allowing at least some of the light from the LEDs to pass through the tube.

Another aspect of some embodiments of the present invention relates to a LED (light emitting diode) bulb comprising: a lighting apparatus and a hollow tube. The lighting apparatus comprises: an elongated central rod, a plurality of installation wheels, a plurality of LEDs, and a plurality of elongated circuit boards. The installation wheels are configured for being traversed by the central rod. Each installation wheel comprises: a loop configured to be traversed by the central rod, the loop having an inner surface configured to engage with the central rod; a plurality of circuit board holders extending radially outward from an outer surface of the loop; a plurality of spikes extending radially outward from the loop. The elongated circuit boards are configured to be electrically connected to a power source of the bulb, each circuit board being configured for transferring power to respective ones of the LEDs and for holding the respective LEDs along a longitudinal length of the circuit board, each circuit board being configured for engaging with and being held by a plurality of circuit board holders aligned with each other, such that the respective LEDs face radially outward. The hollow tube is configured for holding the lighting apparatus, such that the spikes of the installation wheels brace against an inner wall of the tube, so as to maintain a desired distance between the circuit boards and the inner wall of the tube along the length of the tube and to impart structural strength from the hollow tube to the lighting apparatus, the tube being configured for allowing at least some of the light from the LEDs to pass through the tube.

In a variant, the central rod has a radial profile, and the inner surface of each loop has an inner radial profile keyed to match the radial profile of the central rod, such that the installation wheels can be traversed by the central rod only when having a desired orientation. The circuit board holders of the wheels are oriented in the same manner with respect to the inner radial profiles, such that when the wheels are installed on the central rod, the circuit board holders of different wheels are aligned with each other.

In another variant, at least some of the spikes extend from at least some of the circuit board holders. The circuit boards have holes configured for being traversed by the spikes.

In yet another variant, at least some of the spikes are located on an outer surface of the loop and are radially longer than the circuit board holders.

In a further variant, at least some of the circuit boards have notches along elongated sides thereof. At least some of the circuit board holders comprise grips configured for engaging the circuit boards at the notches.

In yet a further variant, the apparatus further comprises an end spike located at an end of the central rod and extending along a longitudinal axis of the central rod.

Optionally, the spikes of the installation wheels and the end spike brace against the inner wall of the tube, so as to maintain a desired distance between the circuit boards and the inner wall of the tube along the length of the tube and to impart structural strength from the hollow tube to the lighting apparatus.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
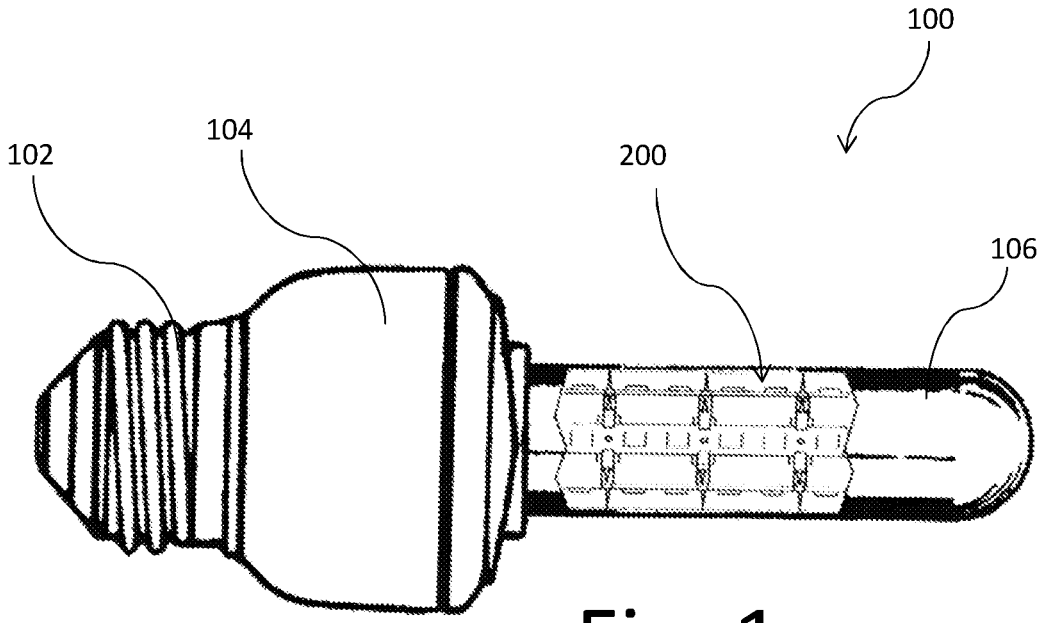
FIG. 1 illustrates a LED light bulb having an Edison screw base, according to some embodiments of the present invention.

FIG. 1 illustrates a LED light bulb 100 having an Edison screw base, according to some embodiments of the present invention.

The light bulb 100 includes an Edison screw 102, a housing 104 containing the power supply, a hollow tube/enclosure 106, and a lighting apparatus 200.

The Edison screw 102 is configured for engaging with a household light fixture, and for receiving electrical power therefrom. The power supply inside the enclosure 104 is configured for receiving electrical power from the Edison screw and for manipulating the electrical power to match the power requirements of the LED chips in the lighting apparatus 200. The lighting apparatus 200 includes a plurality of LED chips facing at least two different directions to provide omnidirectional illumination. The lighting apparatus 200 is configured for providing a structural support LEDs to be held at desired positions, as well as an electrical connection between the power supply and the LEDs, to transfer electrical power from the power supply to the LEDs and thereby cause the LEDs to emit light. Details about the structure of the lighting apparatus 200 will be described below, in the description of FIGS. 3-16. The hollow enclosure 106 is configured for enclosing the lighting apparatus 200 and for allowing at least some of the light emitted by the LEDs to pass therethrough, so as to illuminate a location outside the light bulb.

The housing 104 may be made of any electrically non-conductive material, such as molded plastic, for example. The hollow tube has a closed front end and an open rear end. The rear end is open to allow insertion of the lighting apparatus therein. The rear end is joined to the housing 104 during assembly of the bulb 100. In this manner, the electric components of the lighting apparatus 200 are isolated from a user.

The hollow tube 106 may be made of glass, polycarbonate plastic, or any material that is at least partly transparent to light emitted by LEDs. In some embodiments of the present invention, the hollow tube is coated by a semi-transparent coating having a desired color, configured to converts colored light generated by the LEDs into light of the desired color.

Figure 2:
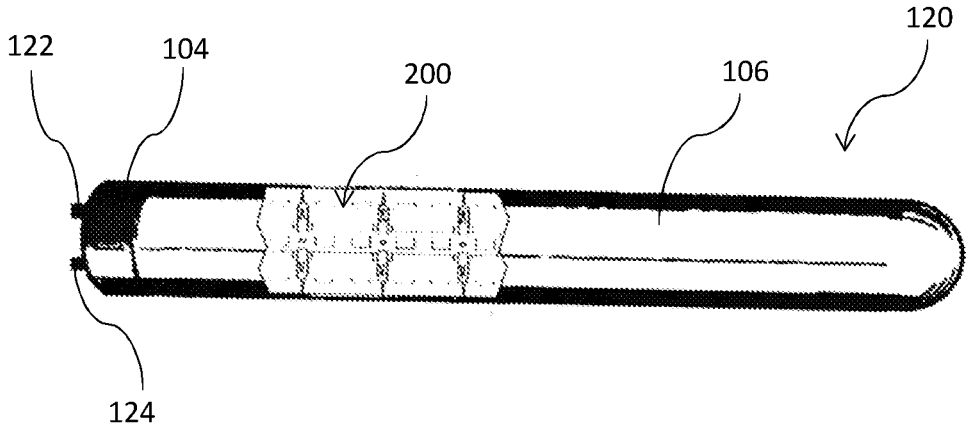
FIG. 2 illustrates a LED light bulb having a PIN electrical type connection having two connector poles configured for connecting to an eternal power supply, according to some embodiments of the present invention.

FIG. 2 illustrates a LED light bulb 120 having a pin electrical type connection having two connector poles configured for connecting to an eternal power supply, according to some embodiments of the present invention.

The difference between the bulb 120 and the bulb 100 of FIG. 1 lies in the type of connector. The connector of the light bulb 120 is a pin connection including the connector poles 122 and 124, configured for connecting to and receiving electrical power from an external power source. The structure of the lighting apparatus 200 and of the hollow tube 106 is the same as described above. This structure can be used with bulbs having different types of connectors and configured for different uses. The specific bulbs shown in FIGS. 1 and 2 are merely non-limiting examples.

Figure 3:
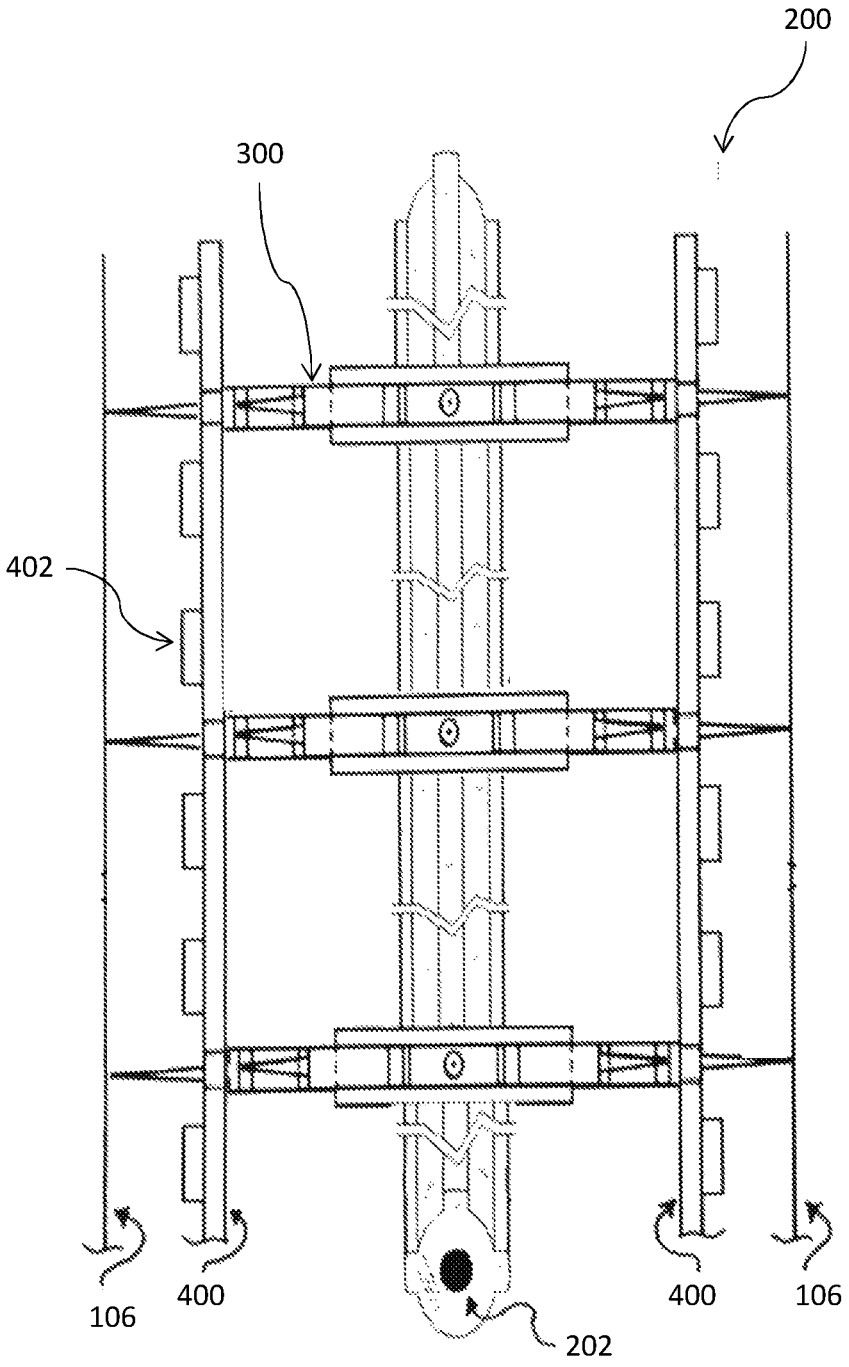
FIG. 3 illustrates a LED lighting apparatus, according to some embodiments of the present invention.

FIG. 3 illustrates a LED lighting apparatus 200, according to some embodiments of the present invention.

The lighting apparatus 200 includes a central rod 202, a plurality of installation wheels 300, and a plurality of circuit boards 400 including LEDs 402 disposed along the circuit boards 400.

The central rod 202 is rigid or semi-rigid and is configured for traversing and engaging with a plurality of installation wheels 300. The installation wheels are configured for holding the circuit boards 400 at desired orientations, with the LEDs 402 facing radially outside. Each circuit board generally provides LED illumination at 180 degrees. Therefore, according to one embodiment of the present invention, the lighting apparatus 200 includes two circuit boards facing away from each other, so that the combined illumination from both circuit boards provides illumination at 360 degrees, that is, omnidirectional illumination.

Figures 4A, 4B:
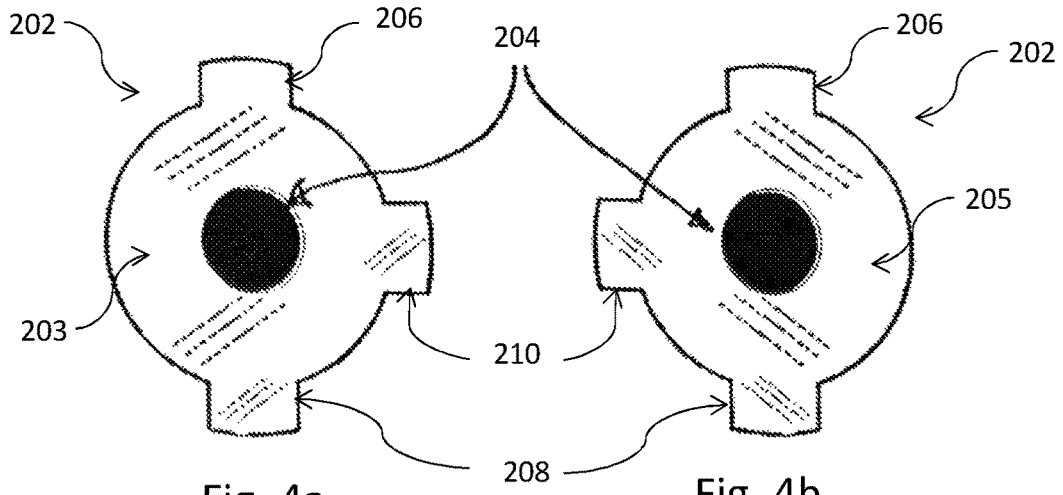
FIGS. 4*a*-4*d* illustrate different views of a central rod of the LED lighting apparatus, according to some embodiments of the present invention.
Figure 4C:
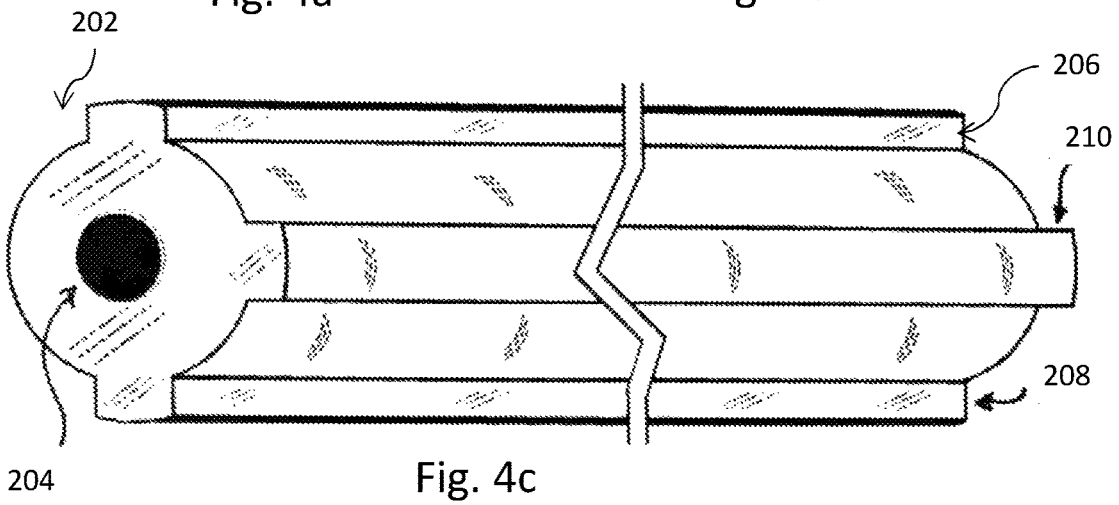
Figure 4D:
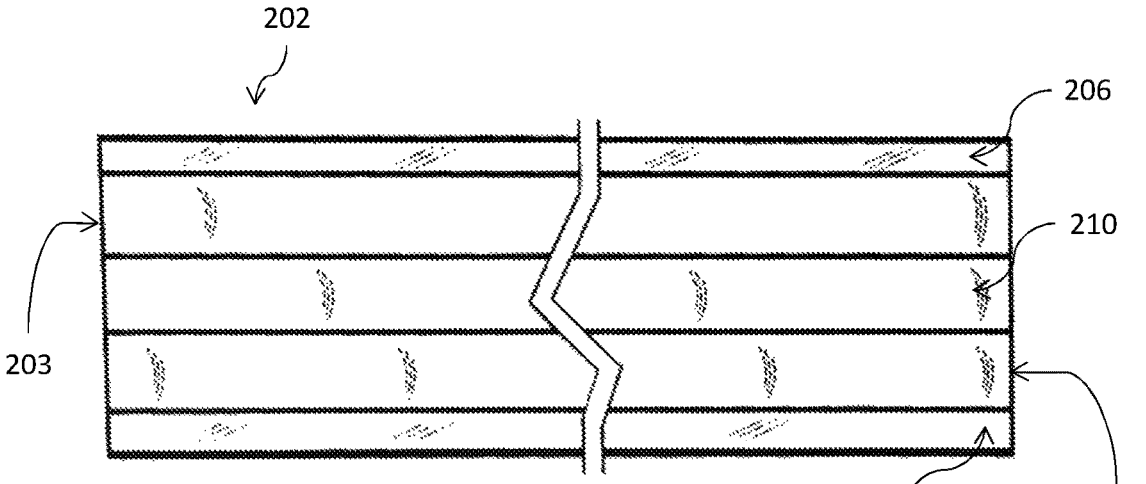

FIGS. 4*a*-4*d* illustrate different views of a central rod 202 of the LED lighting apparatus 200, according to some embodiments of the present invention. FIG. 4*a* is a front view of the central rod 202. FIG. 4*b* is a rear view of the central rod 202. FIG. 4*c* is a perspective view of the central rod 202. FIG. 4*d* is a side view of the central rod 202.

The central rod 202 is an elongated straight rod extending along a central axis thereof. The central rod 202 has a first 203 end and a second end 205. The central rod 202 is rigid or semi-rigid and may be made of any material. According to a non-limiting example the rod is made of extruded heat resistant plastic.

In some embodiments of the present invention, the rod has a desired radial profile as can be clearly seen in FIGS. 4*a* and 4*b*. As will be explained later, the radial profile allows the installation wheels to have a matching radial profile, such that the installation wheels can be traversed by the central rod 202 only when having a desired orientation.

In the non-limiting example of FIGS. 4*a*-4*d*, the radial profile of the central rod 202 is a circular shape having a top protrusion 206, a bottom protrusion, 208, and a side protrusion 210. The protrusions 206, 208, and 210 extend radially out. It should be noted that the central rod may have different radial profiles that may be based on a polygonal shape, a curved shape, or a mixture of both. The shape of the radial profile may sport protrusions and/or grooves.

According to some embodiments of the present invention, the central rod 202 includes a locking mechanism at least one of the ends (203, 205). The locking mechanism is configured for engaging with a central spike that will be described further below. Optionally, the locking mechanism includes a hole 204 located at least one of the ends (203, 205), and extending longitudinally into the central rod.

Figure 5A:
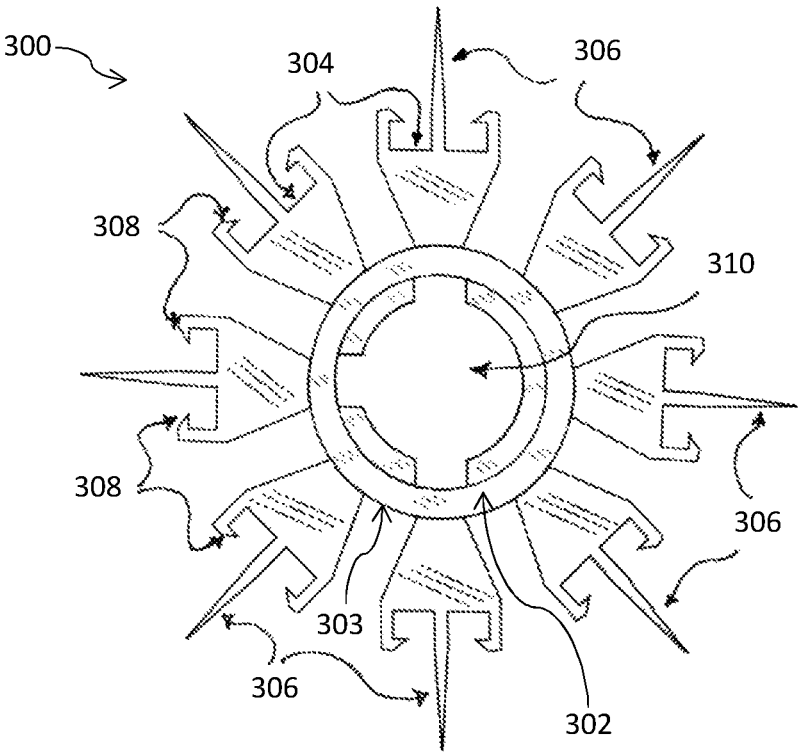
FIGS. 5*a* and 5*b* illustrate different views of an installation wheel of the LED lighting apparatus, in which spikes extend from the circuit board holders, according to some embodiments of the present invention.
Figure 5B:
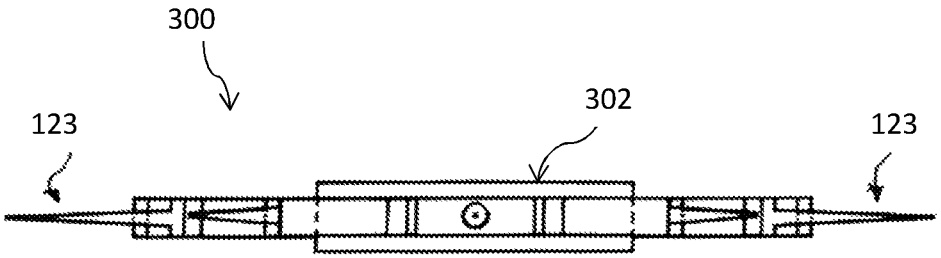

FIGS. 5*a* and 5*b* illustrate different views of an installation wheel 300 of the LED lighting apparatus, in which spikes extend from the circuit board holders, according to some embodiments of the present invention. FIG. 5*a* is a front view of the installation wheel 300. FIG. 5*b* is a top view of the installation wheel 300.

The installation wheel 300 includes a loop 302, a plurality of circuit board holders 304, and a plurality of spikes 306.

The loop 302 is configured for being traversed by the central rod described above and for engaging with the central rod. In some embodiments of the present invention, the radial profile of the inner surface matches the radial profile of the central rod, thus creating an aperture 310 having a shape matching the shape of radial profile of the central rod. In this manner, the installation wheel 300 can be traversed by the central rod only when having a desired orientation.

The circuit board holders 304 extend radially outwards from the outer surface 303 of the loop. Each circuit board holder 304 is configured for engaging with and holding a section of an elongated circuit board holder (which will be described below). A plurality of circuit board holders 304 aligned with each other and belonging to different installation wheels are configured for holding an elongated circuit board.

In some embodiments of the present invention, all the installation wheels of the lighting apparatus are structured in the same manner, so that the circuit board holders of the wheels are oriented in the same manner with respect to the inner radial profiles of the wheels. In this manner, when the wheels are installed on the central rod, the circuit board holders of different wheels are aligned with each other.

The circuit board holders 304 include respective locking mechanism configured for locking the circuit boards in place, to prevent the circuit boards to detaching from the circuit board holders. In some embodiments of the present invention, the locking mechanism of a circuit board holder 304 includes grips 308 located at the sides of the circuit board holder 308. Other types of locking mechanism may be used.

The spikes 306 extend radially outward from the loop. In the example of FIGS. 5*a* and 5*b*, each spike 306 extends from a circuit board holder. The spikes are configured for bracing against the inner wall of the hollow tube, so as to maintain a desired distance between the circuit boards and the inner wall of the tube along the length of the tube, as can be seen, for example in FIG. 3. Furthermore, as will be explained further below, the bracing of the spikes against the hollow tube imparts structural strength from the hollow tube to the apparatus 200, especially to the central rod 202.

A cross-sectional shape of the spikes perpendicular to the spikes' longitudinal length may be curved (e.g. circular) or polygonal (e.g., triangular, rectangular, or square). The outer ends of the spikes 306 (i.e. the ends configured to brace against the inner wall of the hollow tube) may have any shape. The outer ends of the spikes may be rounded or straight. The cross-sectional area of a spike may be constant along the spike's length, may vary at different locations along the spike's length, may increase along the spike's length, or decrease along the spike's length.

The wheel 300 may be formed by a single material molded in the desired shape (e.g., molded plastic). Alternatively, the different parts of the wheel 300 are made by different materials and joined together.

Figures 6A, 6B, 6C, 6D:
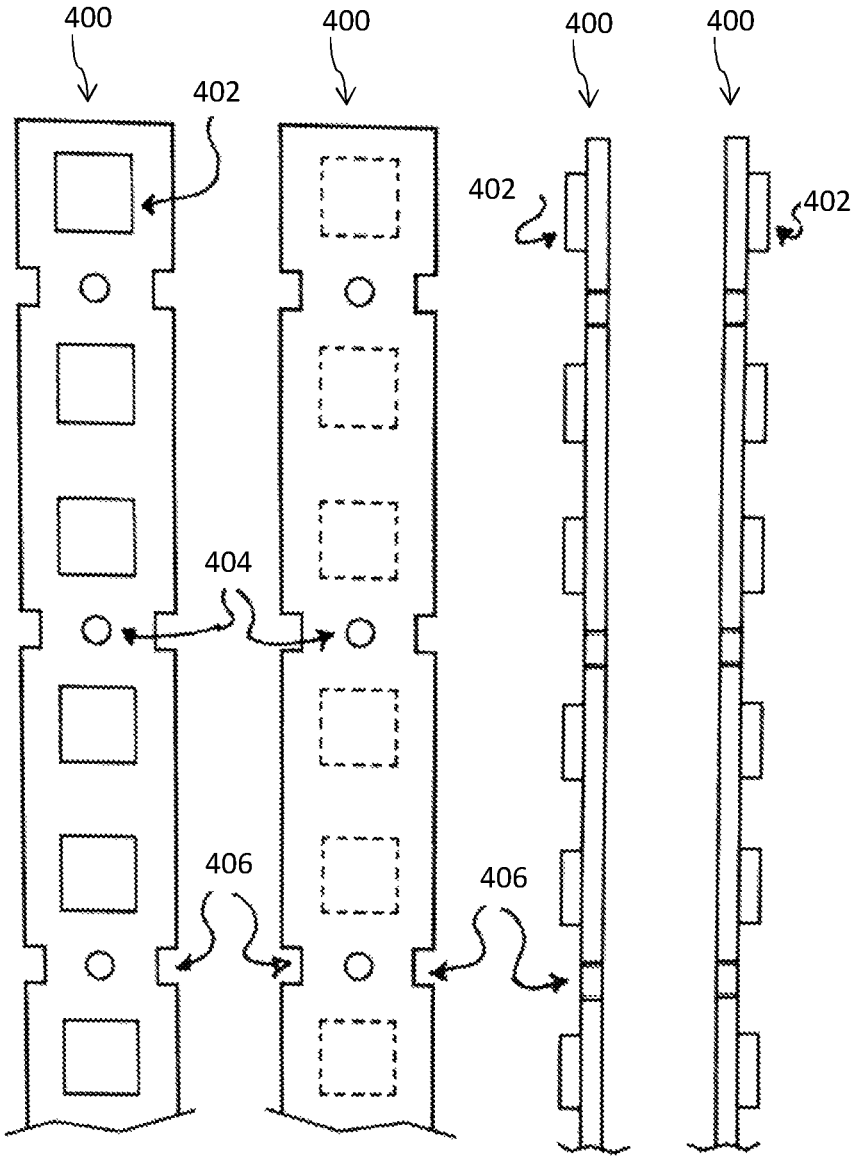
FIGS. 6*a*-6*f* illustrate different views of a circuit board the LED lighting apparatus having holes configured for being traversed by the spikes of the installation wheel of FIGS. 5*a* and 5*b*, according to some embodiments of the present invention.
Figure 6E:
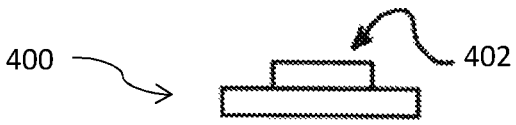
Figure 6F:
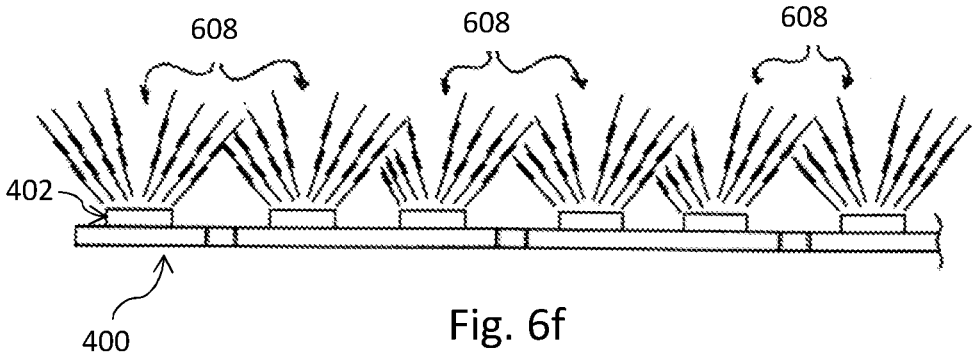

FIGS. 6*a*-6*f* illustrate different views of a circuit board 400 the LED lighting apparatus having holes configured for being traversed by the spikes of the installation wheel of FIGS. 5*a* and 5*b*, according to some embodiments of the present invention. FIG. 6*a* is a top view of the circuit board 400. FIG. 6*b* is a bottom view of the circuit board 400. FIG. 6*c* is a right side view of the circuit board 400. FIG. 6*d* is a left side view of the circuit board 400. FIG. 6*e* is a front view of the circuit board 400. FIG. 6*f* shows light 608 emitted by the LEDs.

The circuit boards 400 are flat elongated boards configured for holding LEDs 402 and transmitting electrical power to the LEDs to turn the LEDs on. A circuit board 400 is configured for holding a plurality of LEDs 402 on a face of the circuit board. The LEDs 402 are disposed along a longitudinal axis of the circuit board 400. The LEDs 402 may be aligned in one or more rows substantially parallel to longitudinal axis of the circuit board. The circuit board 400 is configured to be connected at one end thereof to the power supply of a bulb (as shown in FIGS. 1 and 2) and includes circuitry configured for transmitting electrical current from the power supply to the LEDs 402.

In some embodiments of the present invention, the LEDs 402 are joined to the circuit boards during the fabrication of the circuit boards and are integral with the circuit board 400. In other embodiments of the present invention, the LEDs 402 are LED chips (such as SMD LED chips, for example), and the circuit board 400 includes solder spots configured to receive LED chips' pins or terminals, that may be soldered to the solder spots by hand or by machine (for example, via wave soldering, reflow soldering or other types of soldering). The LEDs used in the apparatus 200 may be chosen according to the needs of the manufacturer or end user. For example, using LED chips may raise the life span of a bulb containing the apparatus 200 to about 50,000 hours.

Though the number of LEDs 402 in FIGS. 6*a*-6*e* is six, the circuit boards used in the lighting apparatus of the present invention may hold any number of LEDs 402. The circuit boards may have any length (any length from less than 4 inches to 48 inches, and over 48 inches).

In some embodiments of the present invention, the circuit board 400 includes holes 404. The holes 404 are configured for being traversed by the spikes 306 extending from the circuit board holders, as shown in FIGS. 5*a* and 5*b*. According to some embodiments of the present invention, the circuit board 400 includes notches along the long sides of the circuit boards at certain locations. Each of these locations may have a pair of notches or a single notch. The notches decrease the width of the boards at the different locations so that the sections of the board 400 where the notches are located can fit be held by the circuit board holders.

As seen in FIG. 6*f*, the illumination emitted by the LEDs on the circuit board is not omni-directional.

Figure 7:
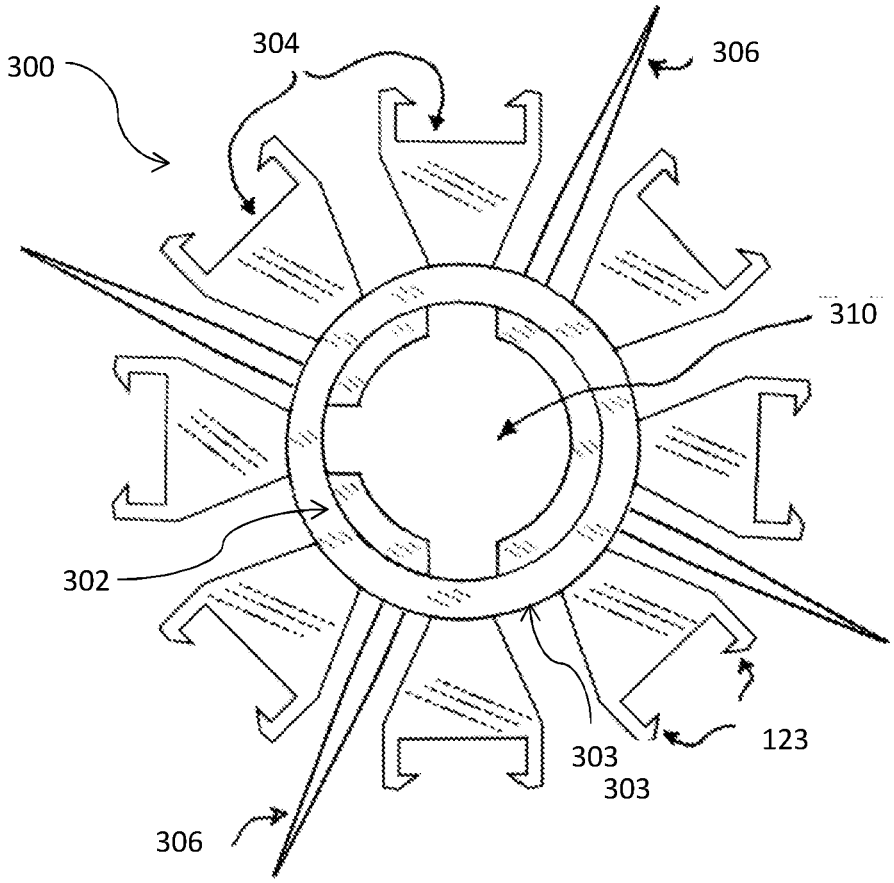
FIG. 7 illustrates a front view of an installation wheel of the LED lighting apparatus, in which spikes extend radially outward from an outer surface of the loop, according to some embodiments of the present invention.
Figures 8A, 8B, 8C, 8D:
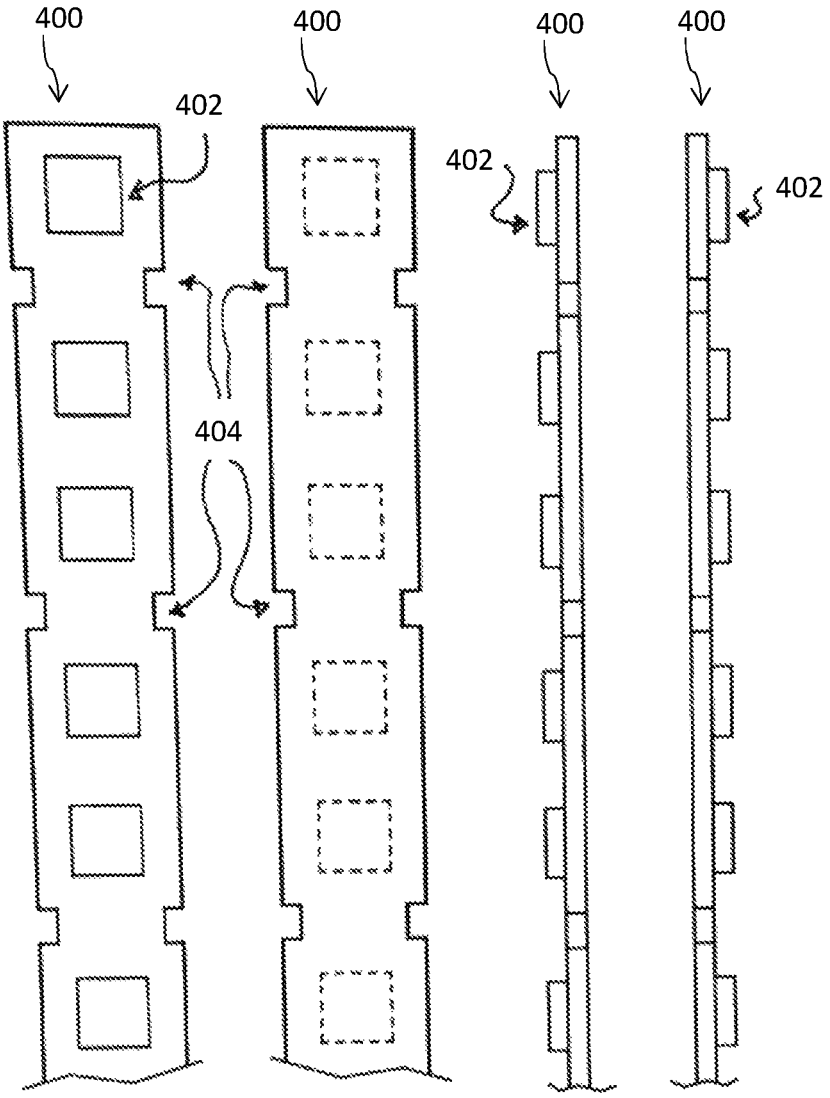
FIGS. 8*a*-8*e* illustrate different views of a circuit board the LED lighting apparatus configured for engaging with the installation wheel of FIG. 7, according to some embodiments of the present invention.
Figure 8E:
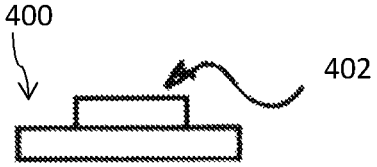

FIG. 7 illustrates a front view of an installation wheel 300 of the LED lighting apparatus, in which spikes extend radially outward from the loop, according to some embodiments of the present invention.

The installation wheel in the example of FIG. 7 has most of the same features of the installation wheel of FIGS. 5*a* and 5*b*. However, in the installation wheel of FIG. 7, the spikes 306 do not extend from the circuit board holders 304. Rather, the spikes 306 extend radially outward from the outer surface 303 of the loop 302. The spikes are radially longer than the circuit board holders 304, in order to maintain a desired distance between the circuit boards and the inner wall of the hollow tubes. There may be any number of spikes.

FIGS. 8*a*-8*e* illustrate different views of a circuit board the LED lighting apparatus configured for engaging with the installation wheel of FIG. 7, according to some embodiments of the present invention.

The circuit board 400 in the example of FIGS. 8*a*-8*e* has most of the same features of the circuit board of FIGS. 6*a*-6*f* However, the circuit board of FIGS. 8*a*-8*e* lacks the hole, as the spikes in the installation wheel of FIG. 7 are not located on the circuit board holders.

Figure 9:
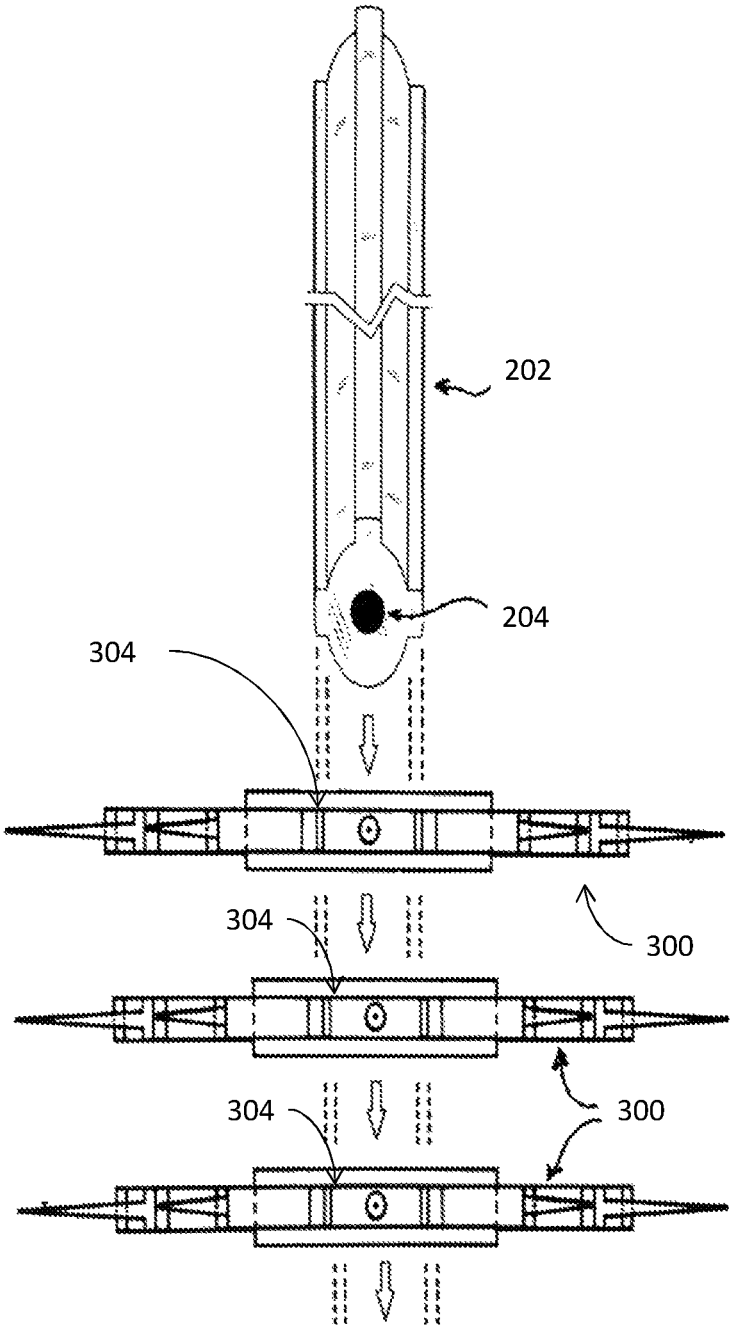
FIG. 9 illustrates an installation of the installation wheels onto the central rod, according to some embodiments of the present invention.

FIG. 9 illustrates an installation of the installation wheels 300 onto the central rod 202, according to some embodiments of the present invention.

Each installation wheel 300 is traversed by the central rod 202 and engages with the central rod 202. As explained above, in some embodiments of the present invention, the inner surfaces of the loops are installation wheels 300 are shaped to match the shape of the central rod 202. Once installed, the circuit board holders of different installation wheels are aligned with each other in rows.

Figure 10:
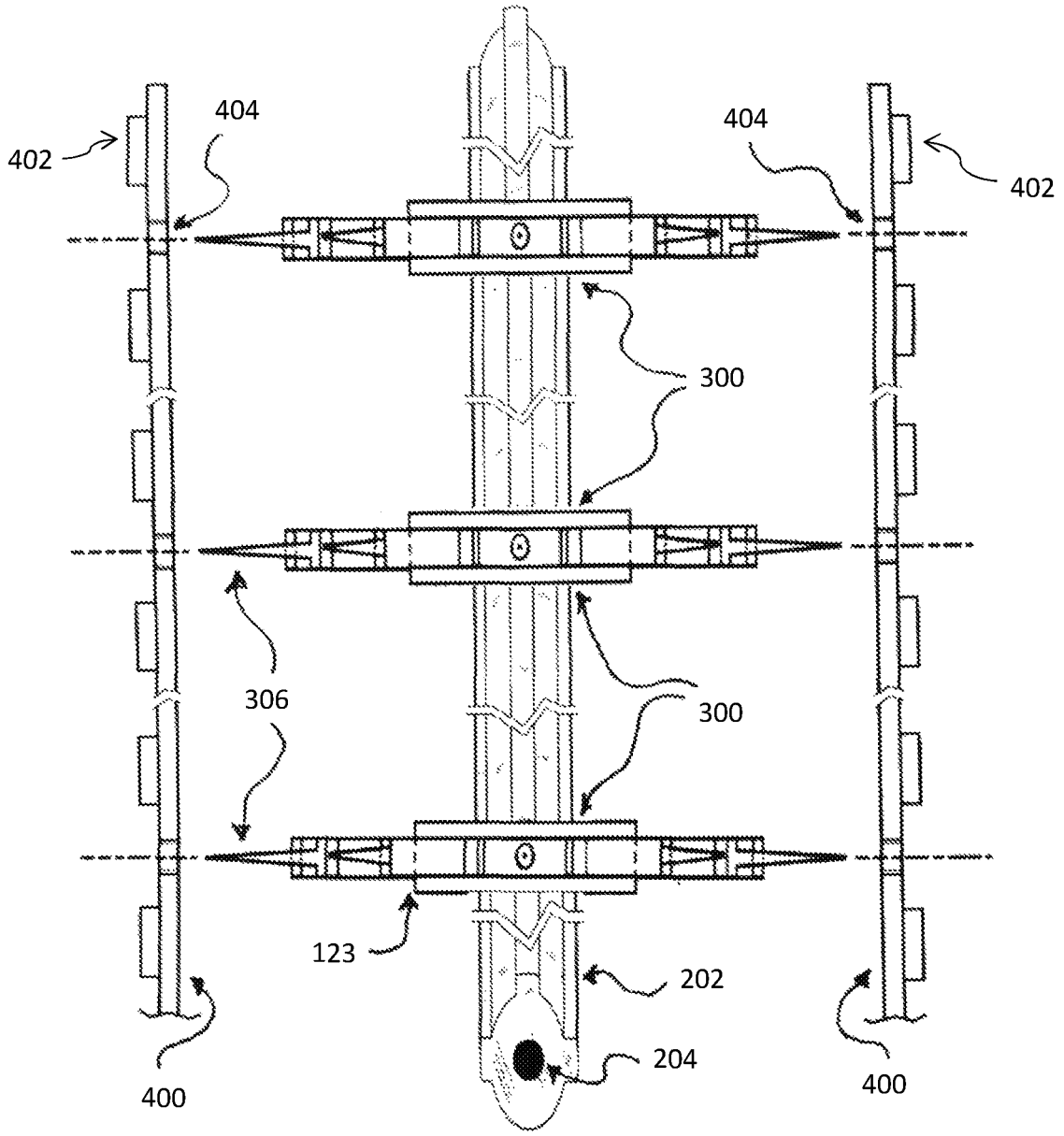
FIG. 10 illustrates an installation of circuit boards on the installation wheels, according to some embodiments of the present invention.

FIG. 10 illustrates an installation of circuit boards on the installation wheels, according to some embodiments of the present invention.

Once the installation wheels 300 are placed at desired locations along the central rod 202 and the circuit board holders of the different wheels are aligned with each other, each circuits board 400 is joined to a respective row of circuit board holders. The circuit boards are installed such that the LEDs 402 face away from the central rod 202.

Figure 11:
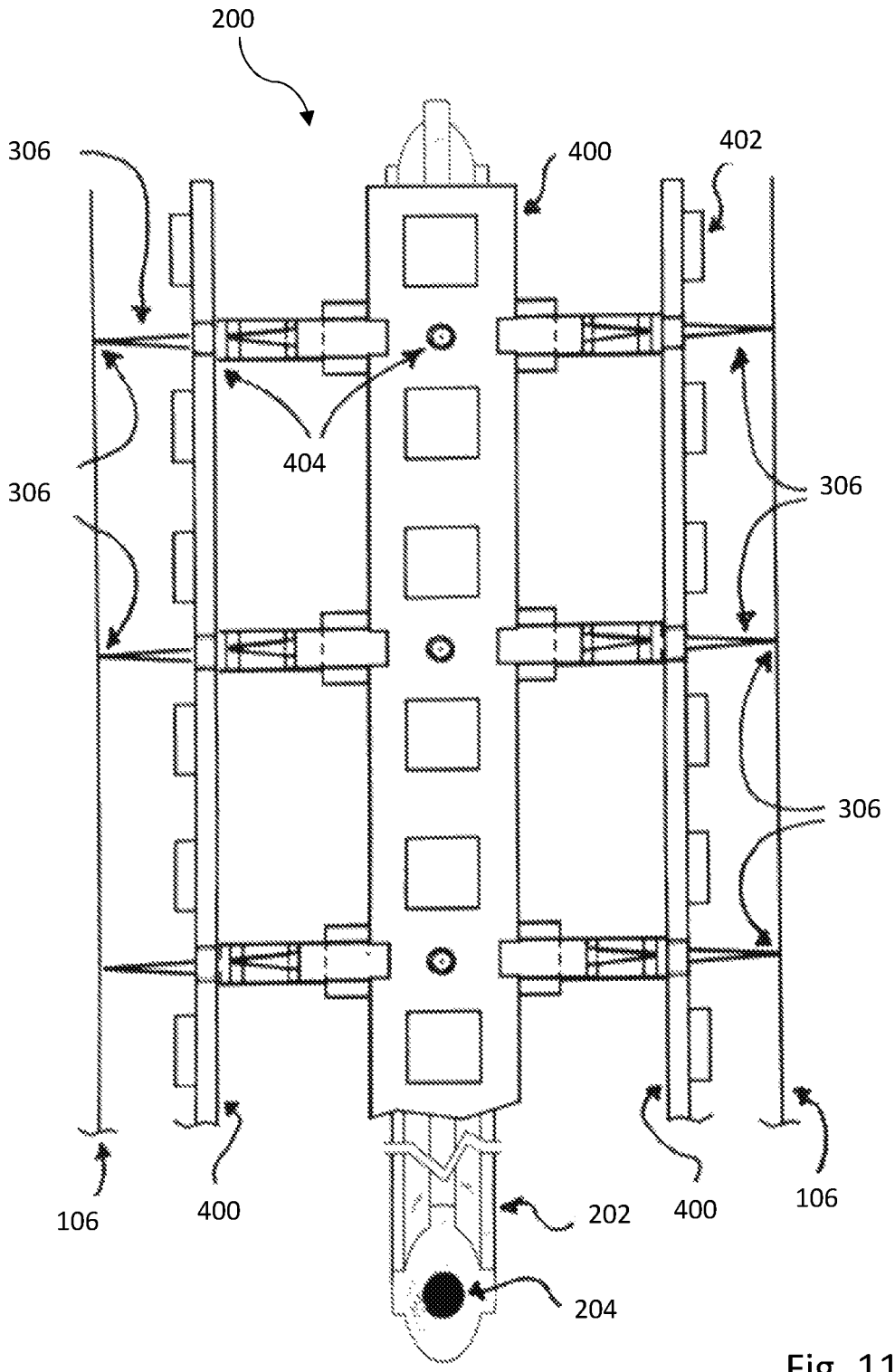
FIG. 11, illustrates a lighting apparatus of the present invention having four circuit boards.
Figure 12:
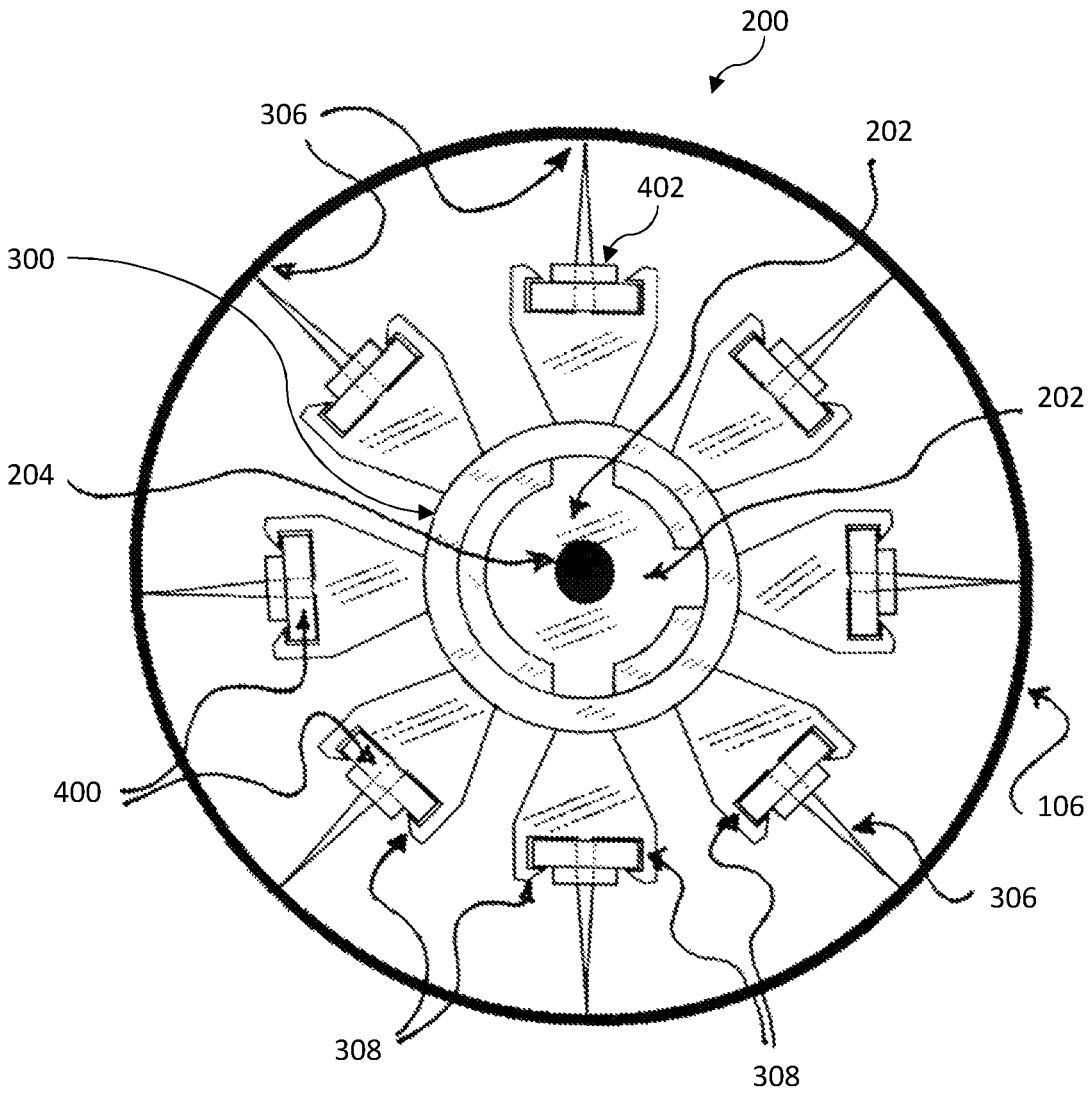
FIG. 12 illustrates a lighting apparatus of the present invention having eight circuit boards.

FIG. 11 is a top view of a lighting apparatus 200 of the present invention having four circuit boards 400. FIG. 12 is a front view of a lighting apparatus 200 of the present invention having eight circuit boards.

Depending on the illumination required, any number of circuit boards may be used. The maximal number of circuit boards that can be used is limited by the number of circuit board holders of the installation wheels. It should be noted that not all rows of circuit boards need be joined to respective circuit boards 400.

In the example of FIG. 11, the desired illumination requires four circuit boards. Three circuit boards out of the four that are installed can be seen, as a bottom circuit board is covered by the top circuit board. In the example of FIG. 12, the desired illumination requires eight circuit boards.

In both FIGS. 11 and 12, it can be seen that the spikes 306 brace against the outer wall of the hollow tube 106. In this manner, as the apparatus 200 is inserted into the hollow tube 106, bending of the central rod 202 is prevented, and the desired distance between the LEDs 402 and the hollow tube 106 is maintained throughout the length of the apparatus 200. Furthermore, bracing against the hollow tube 106 applies radial pressure from a plurality of angles to the apparatus 200 (especially to the central rod 202) and therefore imparts structural strength from the hollow tube to the apparatus 200. Without this structure, the central rod 202 may be inserted into the hollow tube 106 in an erroneous manner and may be oriented such that some of the LEDs touch or are too close to the wall of the hollow tube. This may cause the hollow tube to overheat and break. Furthermore, without this structure, the structural strength of the apparatus 200 may not be high enough and would therefore limit the longitudinal length thereof. The bracing of the spikes against the hollow tube adds structural strength the to the apparatus 200. Therefore, the components of the apparatus 200 may be made of semi-rigid materials, which may be lighter, cheaper, and easier to use than stronger, rigid materials.

Figure 13A:
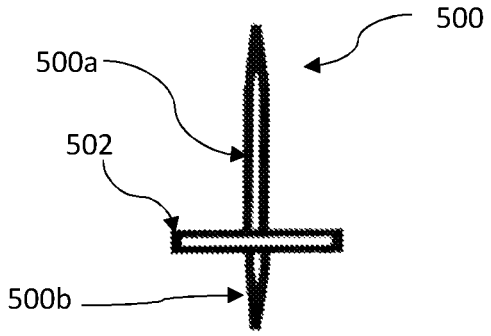
FIGS. 13*a* and 13*b* illustrate different views of an end spike, according to some embodiments of the present invention.
Figure 13B:
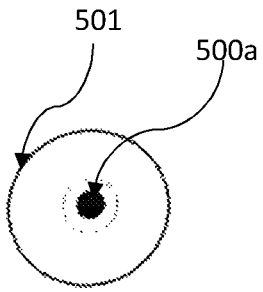
Figure 14:
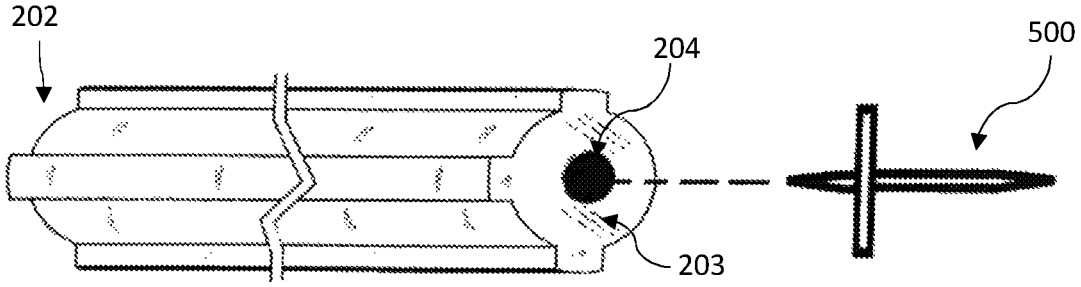
FIG. 14 illustrates an installation of the end spike of FIGS. 13*a* and 13*b* on the central rod, according to some embodiments of the present invention.
Figure 15:
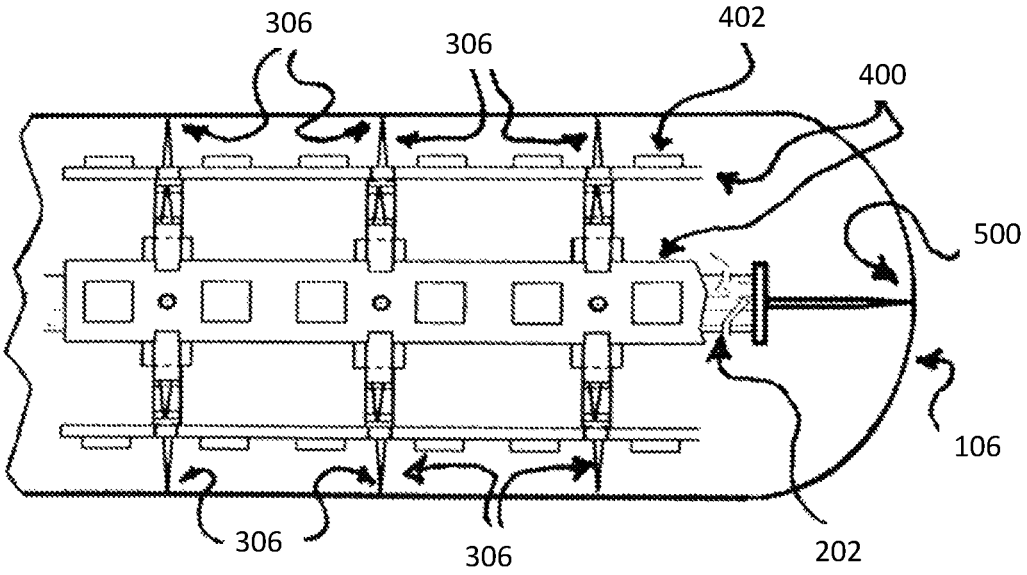
FIG. 15 illustrates a detail of a lighting apparatus including an end spike, according to some embodiments of the present invention.

FIGS. 13*a* and 13*b* illustrate different views of an end spike 500, according to some embodiments of the present invention. FIG. 13*a* is a side view of the end spike 500. FIG. 13*b* is a front view of the spike 500. FIG. 14 illustrates an example of an installation of the end spike 500 of FIGS. 13*a* and 13*b* on the central rod 202, according to some embodiments of the present invention. FIG. 15 illustrates a detail of a lighting apparatus 200 including an end spike, according to some embodiments of the present invention.

In some embodiments of the present invention, the lighting apparatus 200 includes an end spike 500 located at a front end 203 of the central rod 202 and extending from the front end 203 in a direction parallel to that of the longitudinal axis of the central rod 202. In a variant, the end spike 500 is integral with the central rod 202. In another variant, the end spike 500 is a separate unit and is to be installed on the central rod 202. The central rod is configured for maintaining a desired distance between the frontmost LED(s) 402 and the front end of the hollow tube 106. If a desired distance is not maintained between the frontmost LED 402 and the front end of the hollow tube 106, the frontmost LED 402 may overheat the hollow tube 106 and cause the hollow tube to break.

In some embodiments of the present invention, the end spike 500 has a front portion 500*a* and a rear portion 500*b*. The rear portion 500*b* is configured for entering and engaging with the hole 204 at the front end 203 of the central rod 202. The front end of the front portion 500*a* is configured for contacting the front end of the hollow tube.

Optionally, a disk 501 is traversed by the end spike 500 and divides the spike into the front portion 500*a* and the rear portion 500*b*. The disk is larger than the hole 204 and therefore prevents the end spike 500 to enter the hole 204 more than desired. In this manner, the full length of the front portion 500*a* is used to maintain a distance between the frontmost LED and the front end of the hollow tube.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. An elongated LED (light emitting diode) lighting apparatus, comprising:

(i) a central rod;

(ii) a plurality of installation wheels configured for being traversed by the central rod and installed on the central rod so that the installation wheels are spaced apart from each other, each installation wheel comprising:

a loop configured to be traversed by the central rod, the loop having an inner surface configured to engage with the central rod;

a plurality of circuit board holders extending radially outward from an outer surface of the loop;

a plurality of spikes extending radially outward from the loop;

(iii) a plurality of LEDs; and (iv) a plurality of elongated circuit boards configured to be electrically connected to a power source, each circuit board being configured for transferring power to respective ones of the LEDs and for holding the respective LEDs along a longitudinal length of the circuit board, each circuit board being configured for engaging with and being held by a plurality of circuit board holders aligned with each other and spaced apart from each other, such that the respective LEDs face radially outward.

2. The apparatus of claim 1, wherein:

the central rod has a radial profile, and the inner surface of each loop has an inner radial profile keyed to match the radial profile of the central rod, such that the installation wheels can be traversed by the central rod only when having a desired orientation;

the circuit board holders of the wheels are oriented in the same manner with respect to the inner radial profiles, such that when the wheels are installed on the central rod, the circuit board holders of different wheels are aligned with each other.

3. The apparatus of claim 1, wherein:

at least some of the spikes extend from at least some of the circuit board holders; and the circuit boards have holes configured for being traversed by the spikes.

4. The apparatus of claim 1, wherein the spikes are located on an outer surface of the loop and are radially longer than the circuit board holders.

5. The apparatus of claim 1, wherein:

at least some of the circuit boards have notches along elongated sides thereof;

at least some of the circuit board holders comprise grips configured for engaging the circuit boards at the notches.

6. The apparatus of claim 1, further comprising a hollow tube configured for holding the central rod, the installation wheels, and circuit boards, such that the spikes of the installation wheels brace against an inner wall of the tube, so as to maintain a desired distance between the circuit boards and the inner wall of the tube along the length of the tube and to impart structural strength from the hollow tube to the central rod, the tube being configured for allowing at least some of the light from the LEDs to pass through the tube.

7. The apparatus of claim 1, further comprising an end spike located at an end of the central rod and extending along a longitudinal axis of the central rod.

8. The apparatus of claim 7, further comprising a hollow tube configured for holding the central rod, the installation wheels, and circuit boards, such that the spikes of the installation wheels and the end spike brace against an inner wall of the tube, so as to maintain a desired distance between the circuit boards and the inner wall of the tube along the length of the tube and to impart structural strength from the hollow tube to the central rod, the tube being configured for allowing at least some of the light from the LEDs to pass through the tube.

9. An LED (light emitting diode) bulb comprising:

(i) a lighting apparatus comprising:

(a) an elongated central rod;

(b) a plurality of installation wheels configured for being traversed by the central rod and installed on the central rod so that the installation wheels are spaced apart from each other, each installation wheel comprising:

a loop configured to be traversed by the central rod, the loop having an inner surface configured to engage with the central rod;

a plurality of circuit board holders extending radially outward from an outer surface of the loop;

a plurality of spikes extending radially outward from the loop;

(c) a plurality of LEDs; and (d) a plurality of elongated circuit boards configured to be electrically connected to a power source of the bulb, each circuit board being configured for transferring power to respective ones of the LEDs and for holding the respective LEDs along a longitudinal length of the circuit board, each circuit board being configured for engaging with and being held by a plurality of circuit board holders aligned with each other and spaced apart from each other, such that the respective LEDs face radially outward;

and (ii) a hollow tube configured for holding the lighting apparatus, such that the spikes of the installation wheels brace against an inner wall of the tube, so as to maintain a desired distance between the circuit boards and the inner wall of the tube along the length of the tube and to impart structural strength from the hollow tube to the lighting apparatus, the tube being configured for allowing at least some of the light from the LEDs to pass through the tube.

10. The apparatus of claim 9, wherein:

the central rod has a radial profile, and the inner surface of each loop has an inner radial profile keyed to match the radial profile of the central rod, such that the installation wheels can be traversed by the central rod only when having a desired orientation;

the circuit board holders of the wheels are oriented in the same manner with respect to the inner radial profiles, such that when the wheels are installed on the central rod, the circuit board holders of different wheels are aligned with each other.

11. The apparatus of claim 9, wherein:

at least some of the spikes extend from at least some of the circuit board holders; and the circuit boards have holes configured for being traversed by the spikes.

12. The apparatus of claim 9, wherein at least some of the spikes are located on an outer surface of the loop and are radially longer than the circuit board holders.

13. The apparatus of claim 9, wherein:

at least some of the circuit boards have notches along elongated sides thereof;

at least some of the circuit board holders comprise grips configured for engaging the circuit boards at the notches.

14. The apparatus of claim 9, further comprising an end spike located at an end of the central rod and extending along a longitudinal axis of the central rod.

15. The apparatus of claim 14, wherein the spikes of the installation wheels and the end spike brace against the inner wall of the tube, so as to maintain a desired distance between the circuit boards and the inner wall of the tube along the length of the tube and to impart structural strength from the hollow tube to the lighting apparatus.

16. An elongated LED (light emitting diode) lighting apparatus, comprising:

(i) a central rod;

(ii) a plurality of installation wheels configured for being traversed by the central rod, each installation wheel comprising:

a loop configured to be traversed by the central rod, the loop having an inner surface configured to engage with the central rod;

a plurality of circuit board holders extending radially outward from an outer surface of the loop;

a plurality of spikes extending radially outward from the loop;

(iii) a plurality of LEDs; and (iv) a plurality of elongated circuit boards configured to be electrically connected to a power source, each circuit board being configured for transferring power to respective ones of the LEDs and for holding the respective LEDs along a longitudinal length of the circuit board, each circuit board being configured for engaging with and being held by a plurality of circuit board holders aligned with each other, such that the respective LEDs face radially outward;

wherein:

the central rod has a radial profile, and the inner surface of each loop has an inner radial profile keyed to match the radial profile of the central rod, such that the installation wheels can be traversed by the central rod only when having a desired orientation;

the circuit board holders of the wheels are oriented in the same manner with respect to the inner radial profiles, such that when the wheels are installed on the central rod, the circuit board holders of different wheels are aligned with each other.

17. The apparatus of claim 16, wherein:

at least some of the spikes extend from at least some of the circuit board holders; and the circuit boards have holes configured for being traversed by the spikes.

18. The apparatus of claim 16, wherein the spikes are located on an outer surface of the loop and are radially longer than the circuit board holders.

19. The apparatus of claim 16, wherein:

at least some of the circuit boards have notches along elongated sides thereof;

at least some of the circuit board holders comprise grips configured for engaging the circuit boards at the notches.

20. The apparatus of claim 1, further comprising a hollow tube configured for holding the central rod, the installation wheels, and circuit boards, such that the spikes of the installation wheels brace against an inner wall of the tube, so as to maintain a desired distance between the circuit boards and the inner wall of the tube along the length of the tube and to impart structural strength from the hollow tube to the central rod, the tube being configured for allowing at least some of the light from the LEDs to pass through the tube.

* * * * *